US009278800B2

(12) United States Patent
Seo et al.

(10) Patent No.: US 9,278,800 B2
(45) Date of Patent: Mar. 8, 2016

(54) COSMETIC RAW MATERIAL CAPSULE FOR SEPARATING AND ACCOMMODATING COSMETIC RAW MATERIALS, AND APPARATUS FOR PRODUCING COSMETICS USING THE CAPSULE

(71) Applicants: Woong Jin Seo, Yongin-si (KR); You Young Jang, Yongin-si (KR)

(72) Inventors: Woong Jin Seo, Yongin-si (KR); You Young Jang, Yongin-si (KR)

( * ) Notice: Subject to any disclaimer, the term of this patent is extended or adjusted under 35 U.S.C. 154(b) by 134 days.

(21) Appl. No.: 14/110,792

(22) PCT Filed: Sep. 27, 2012

(86) PCT No.: PCT/KR2012/007879

§ 371 (c)(1),
(2) Date: Oct. 23, 2013

(87) PCT Pub. No.: WO2013/048167

PCT Pub. Date: Apr. 4, 2013

(65) Prior Publication Data

US 2014/0050044 A1 Feb. 20, 2014

(30) Foreign Application Priority Data

Sep. 27, 2011 (KR) ..... 10-2011-0097858

(51) Int. Cl.

| | |
|---|---|
| ***B01F 11/02*** | (2006.01) |
| ***B01F 15/06*** | (2006.01) |
| ***B65D 85/00*** | (2006.01) |
| ***B01F 15/02*** | (2006.01) |
| ***B65D 25/08*** | (2006.01) |
| ***B01F 7/18*** | (2006.01) |
| *A45D 40/00* | (2006.01) |
| *A45D 40/24* | (2006.01) |

(52) U.S. Cl.
CPC . *B65D 85/70* (2013.01); *B01F 7/18* (2013.01); *B01F 11/0225* (2013.01);

(Continued)

(58) Field of Classification Search
CPC .. B01F 15/065; B01F 15/021; B01F 15/0212; A47G 19/2288; B65D 25/08
USPC ..... 366/117, 144; 206/219, 222; 215/DIG. 8; 132/320
See application file for complete search history.

(56) References Cited

U.S. PATENT DOCUMENTS 5,052,553 A * 10/1991 De Sanctis ..... B65D 51/2814 206/219
5,284,275 A * 2/1994 Shomer ..... B01F 5/0683 206/219

(Continued)

FOREIGN PATENT DOCUMENTS

JP 2-45982 U 3/1990
JP 2004-35112 A 2/2004

(Continued)

OTHER PUBLICATIONS

International Searching Authority International Search Report for PCT/KR2012/007879 dated Feb. 19, 2013.

*Primary Examiner* — Tony G Soohoo
*Assistant Examiner* — Elizabeth Insler
(74) *Attorney, Agent, or Firm* — STIP Law Group, LLC

(57) ABSTRACT

The present invention relates to a cosmetic raw material capsule for separating and accommodating cosmetic raw materials, including: an accommodating portion (110) for accommodating at least two cosmetic raw materials; a protective film (120) arranged on the accommodating portion (110) so as to cover and seal the accommodating portion (110); and a separation film (130) arranged on the accommodating portion (110) so as to separate at least two cosmetic raw materials. Thus, cosmetic raw materials required for producing cosmetics can be contained in a single container so as to enable the simple production of cosmetics.

8 Claims, 7 Drawing Sheets

(52) U.S. Cl.
CPC ..... *B01F 11/0258* (2013.01); *B01F 15/0212* (2013.01); *B01F 15/06* (2013.01); *B01F 15/065* (2013.01); *B65D 25/08* (2013.01); *A45D 40/0068* (2013.01); *A45D 40/24* (2013.01); *B01F 2015/061* (2013.01); *B01F 2015/062* (2013.01)

(56) References Cited

U.S. PATENT DOCUMENTS 6,021,642 A * 2/2000 Guinn ..... A45C 5/005 62/235.1
7,028,869 B2 * 4/2006 De Laforcade ..... 222/633
2002/0104547 A1 * 8/2002 Stevenson ..... A45D 34/045 132/218
2005/0169099 A1 * 8/2005 Sprinkle ..... 366/152.5
2009/0071499 A1 * 3/2009 Wyatt ..... A45D 40/265 132/218
2011/0019496 A1 * 1/2011 Hsieh et al. ..... 366/111

FOREIGN PATENT DOCUMENTS

JP 2009-12802 A 1/2009
JP 2009-29442 A 2/2009
KR 10-2010-0119990 A 11/2010

* cited by examiner

COSMETIC RAW MATERIAL CAPSULE FOR SEPARATING AND ACCOMMODATING COSMETIC RAW MATERIALS, AND APPARATUS FOR PRODUCING COSMETICS USING THE CAPSULE

CROSS REFERENCE TO RELATED APPLICATIONS

This application is a National Stage of International Application No. PCT/KR2012/007879 filed Sep. 27, 2012, claiming priority based on Korean Patent Application No. 10-2011-0097858 filed Sep. 27, 2011, the contents of all of which are incorporated herein by reference in their entirety.

TECHNICAL FIELD

The present invention relates to a cosmetic raw material capsule, and more particularly, to a cosmetic raw material capsule for separating and accommodating cosmetic raw materials, and an apparatus for producing cosmetics using the cosmetic raw material capsule.

BACKGROUND ART

Generally, cosmetics usually refer to goods applied to change the appearance to be brighter or maintain or increase the health of skin and hair by cleansing or beautifying the body. Cosmetics need to have the minor effect on the human body. The types of cosmetics include fundamental cosmetics such as cream, lotion, skin lotion, tonic, mask pack, etc., for cleansing and moisturizing of skin for healthy, makeup cosmetics to glamorize and change the look such as the facial powder, liquid, foundation, lipstick, etc., hair cosmetics to protect and take care of hair such as hair tonic, hair cream, hair oil, shampoo, hair spray, etc., and men's cosmetics including aftershave lotion, shaving cream, men's lotion, etc. Additionally, various types of cosmetics, for example, perfume, scented products, etc., are being produced for sale.

Usually, people buy and use these cosmetics produced and sold by the manufacturers. However, since typical cosmetics that are being produced are mass-produced and sold by the manufacturers, it is difficult to meet the demand of people who have various skin conditions. For this reason, it is difficult for people to buy cosmetics in consideration of different skin conditions of each individual. Since cosmetics produced by the manufacturer are also sold in a large quantity to be used for a long time, not for one or two-time use, cosmetics contain preservatives for long-term storage that may cause skin troubles. Furthermore, the sales price is expensive, imposing a financial burden on a user.

Accordingly, various types of cosmetic raw materials that are produced using natural materials or solidified or liquefied materials produced by grinding natural materials are being recently sold. More consumers are selecting raw materials suitable for their skin type and making their own cosmetics in small amounts. In order to produce cosmetics, nevertheless, both water-soluble materials and fat-soluble materials are basically needed. However, since existing cosmetic raw material products contain only one of two raw materials in a single container, consumers have to go through the hassle of buying each raw material separately.

To make cosmetics with cosmetic raw materials at home, there is another inconvenience of using kitchen utensils such as a pot, a gas range, etc. In this case, since the same pot used for cooking is used to make cosmetics again, there is a high possibility that impurities may be mixed in the pot though the pot is washed clean, which can have a negative influence on the sanitary condition or the quality of cosmetics. Moreover, there is still no device that is specially devised to immediately produce a small amount of cosmetics using cosmetic raw materials.

SUMMARY OF INVENTION

Technical Problem

The present invention is proposed for solving the above problems of the existing methods, and an object of the prevent invention is to provide a cosmetic raw material capsule for separating and accommodating cosmetics raw materials, which includes an accommodating portion (110) for accommodating at least two cosmetic raw materials, a protective film (120) disposed over the accommodating portion (110) to cover and seal the accommodating portion (110), and a separation film (130) disposed in the accommodating portion (110) to separate the at least two cosmetic raw materials from each other. Since cosmetic raw materials necessary for producing cosmetics are contained in a single container, cosmetics can be conveniently produced.

Also, another object of the present invention is to provide an apparatus for producing cosmetics using a cosmetic raw material capsule, which includes an injector (210) for injecting the cosmetic raw material capsule, a heater (220) disposed under the injector (210) to heat the cosmetic raw material capsule, and a cooler (230) disposed at a side of the injector (210) to cool the cosmetic raw material capsule, so that a small amount of cosmetics required can be immediately produced using the cosmetic raw material capsule, thereby enabling a user to use fresh cosmetics.

Solution to Problem

According to the feature of the present invention for achieving the above objects, a cosmetic raw material capsule for separating and accommodating cosmetic raw materials includes: an accommodating portion (110) for accommodating at least two cosmetic raw materials; a protective film (120) disposed over the accommodating portion (110) to cover and seal the accommodating portion (110); and a separation film (130) disposed in the accommodating portion (110) to separate the at least two cosmetic raw materials from each other.

Preferably, the accommodating portion (110) may include: a first accommodating portion (111) for accommodating an oil-based material; and a second accommodating portion (112) for accommodating a water-based material.

Preferably, the cosmetic raw material capsule may further include a blocking portion (140) that is disposed between the accommodating portion (110) and the protective film (120) to prevent the at least two cosmetic raw materials from escaping from the accommodating portion (110).

Preferably, the protective film (120) may further include a grip portion (121) that is disposed at an end of the protective film (120) such that a user grips the grip portion (121) with fingers to easily remove the protective film (120).

Preferably, the separation film (130) may be formed of paper or vinyl.

More preferably, the separation film may (130) be formed of a material capable of melting with heat.

According to the feature of the present invention for achieving the above objects, an apparatus for producing cosmetics using a cosmetic raw material capsule includes: an injector (210) for injecting the cosmetic raw material capsule; a heater (220) disposed under the injector (210) to heat the cosmetic raw material capsule; and a cooler (230) disposed at a side of the injector (210) to cool the cosmetic raw material capsule.

Preferably, the injector (210) may include: a support (211) for supporting the cosmetic raw material capsule; a cover (212) disposed over the support (211) to cover the cosmetic raw material capsule; and an agitator (213) penetrating the cosmetic raw material capsule in combination with the cover (212) to agitate cosmetic raw materials contained in the cosmetic raw material capsule.

Preferably, the agitator (213) may further include an ultrasonic vibrator that is disposed at a lower end of the agitator (213) to generate an ultrasonic wave.

Preferably, the apparatus for producing cosmetics may further include a controller (240) for controlling an operation of the apparatus for producing cosmetics.

Advantageous Effects of Invention

A cosmetic raw material capsule for separating and accommodating cosmetics raw materials according to the present invention may include an accommodating portion (110) for accommodating at least two cosmetic raw materials, a protective film (120) disposed over the accommodating portion (110) to cover and seal the accommodating portion (110), and a separation film (130) disposed in the accommodating portion (110) to separate the at least two cosmetic raw materials from each other. Thus, since cosmetic raw materials necessary for producing cosmetics are contained in a single container, cosmetics can be conveniently produced.

Also, an apparatus for producing cosmetics using a cosmetic raw material capsule according to the present invention may include an injector (210) for injecting the cosmetic raw material capsule, a heater (220) disposed under the injector (210) to heat the cosmetic raw material capsule, and a cooler (230) disposed at a side of the injector (210) to cool the cosmetic raw material capsule. Thus, a small amount of cosmetics required can be immediately produced using the cosmetic raw material capsule, thereby enabling a user to use fresh cosmetics.

<Description of Reference numerals>

Figure 1:
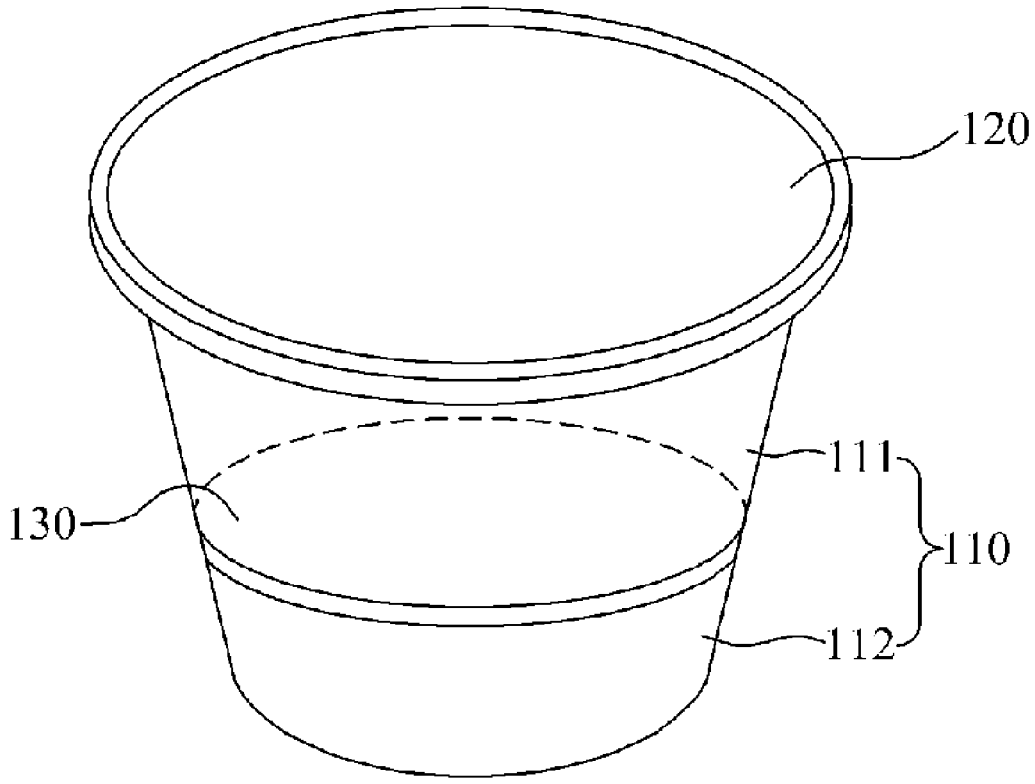
FIG. 1 is an exploded perspective view illustrating a cosmetic raw material capsule (100) for separating and accommodating cosmetic raw materials according to an embodiment of the present invention.

| | |
|---|---|
| 100: cosmetic raw material capsule | 110: accommodating portion |
| 111: first accommodating portion | 112: second accommodating portion |
| 120: protective film | 121: grip portion |
| 130: separation film | 140: blocking portion |
| 200: apparatus for producing cosmetics | 210: injector |
| 211: support | 212: cover |
| 213: agitator | 220: heater |
| 230: cooler | 240: controller |
| 241: main controller | 242: agitator controller |
| 243: heater controller | 244: cooler controller |

DESCRIPTION OF EMBODIMENTS

Hereinafter, exemplary embodiments of the present invention will be described in detail with reference to the accompanying drawings so that those skilled in the art can easily carry out the present invention. However, detailed descriptions related to well-known functions or configurations will be ruled out in order not to unnecessarily obscure subject matters of the present invention. Also, like reference numerals refer to like elements throughout.

In this disclosure below, when one part (or element, device, etc.) is referred to as being 'connected' to another part (or element, device, etc.), it should be understood that the former can be 'directly connected' to the latter, or 'indirectly connected' to the latter via an intervening part (or element, device, etc.). Furthermore, when it is described that one comprises (or includes or has) some elements, it should be understood that it may comprise (or include or has) only those elements, or it may comprise (or include or have) other elements as well as those elements if there is no specific limitation.

FIG. 1 is an exploded perspective view illustrating a cosmetic raw material capsule 100 for separating and accommodating cosmetic raw materials according to an embodiment of the present invention. As shown in FIG. 1, the cosmetic raw material capsule 100 for separating and accommodating cosmetic materials may include an accommodating portion 110, a protective film 120, and a separation film 130.

The accommodating portion 110, which is a component for accommodating cosmetic raw materials, may be configured to accommodate at least two cosmetic raw materials. That is, the accommodating portion 110 may include a first accommodating portion 111 for accommodating an oil-based material and a second accommodating portion 112 for accommodating a water-based material. Examples of oil-based materials may include mink oil, lavender, chamomile, peppermint, spearmint, palmarosa, and jojoba, and examples of water-based materials may include purified water, green tea extract, chamomile water, and rosemary water, but the present invention is not limited thereto. The accommodating portion 110 may have a cylindrical or cuboidal shape, and may be formed of a material that allows heat by a heater 220 to be effectively delivered to oil- and water-based materials.

The protective film 120 may be disposed in the accommodating portion 110 to seal the accommodating portion 110. The protective film 120 may be attached to the upper portion of the accommodating portion 110 by a sticker type having a strong adhesive strength, and may be formed of a synthetic resin material such as polypropylene. Also, an advertising image of a corresponding cosmetic raw material may be printed on the protective film 120 to display an advertising effect.

Figure 2:
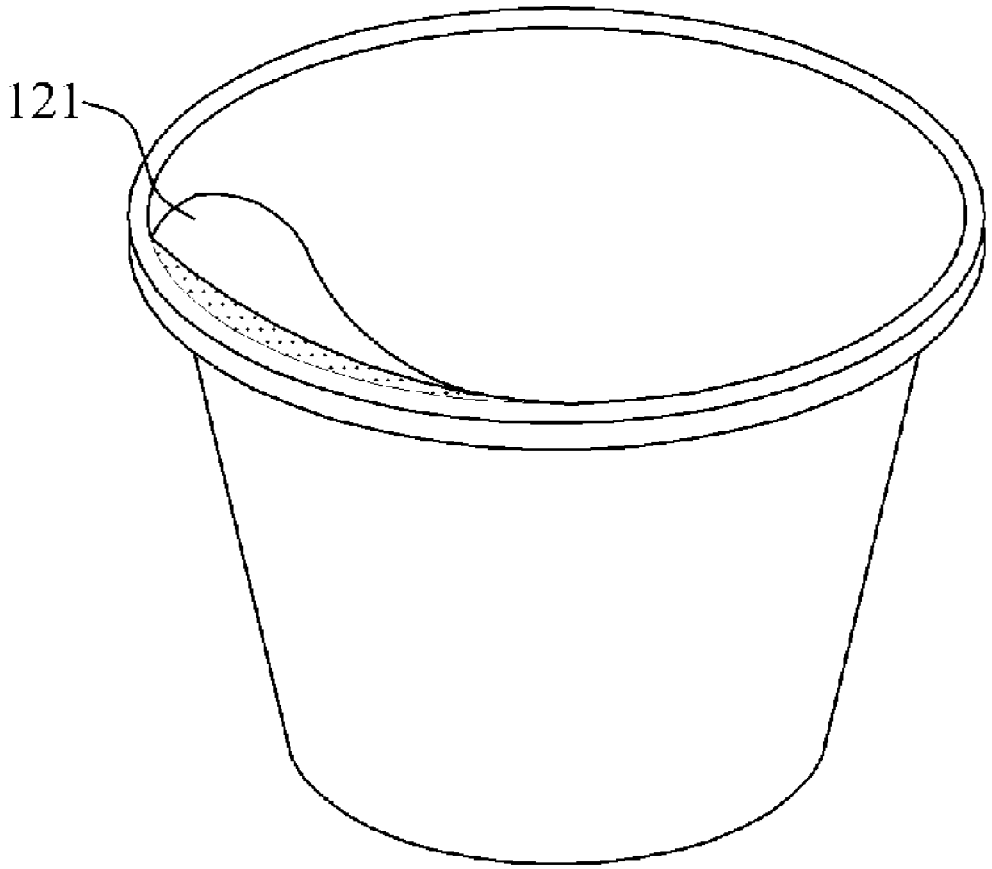
FIG. 2 is a view illustrating a grip portion (121) in the cosmetic raw material capsule (100) for separating and accommodating cosmetic raw materials according to an embodiment of the present invention.

As shown in FIG. 2, the protective film 120 may be configured to further include a grip portion 121 at the end of the protective film 120. The protective film 120 needs to be removed from the accommodating portion 110 to use cosmetics that are produced by an apparatus for producing cosmetics using the cosmetic raw material capsule 100, which is to be described later. For this, the grip portion 121 may be disposed at the end of the protective film 120 such that a user can grip the protective film 120 with his/her fingers to easily remove the protective film 120. For convenience of explanation, the grip portion 121 is shown as being disposed at the end portion of the protective film 12, but the location of the grip portion 121 is not limited thereto.

The separation film 130 may be disposed in the accommodating portion 110 to separate at least two cosmetic raw materials from each other. That is, the separation film 130, as shown in FIG. 1, may divide the accommodating portion 110 into at least two regions such as the first accommodating portion 111 and the second accommodating portion 112, such that cosmetic raw materials accommodated in the first and second accommodating portions 111 and 112 are not mixed with each other. Meanwhile, when the cosmetic raw material capsule 100 is distributed or stored, the separation film 130 needs to maintain a condition that cosmetic raw materials are not mixed with each other. However, in order to produce cosmetics using the cosmetic raw material capsule 100 in the apparatus for producing cosmetics to be described later, the separation film 130 needs to be appropriately removed such that cosmetic raw materials are mixed with each other. For this, the separation film 130 may be formed of an easily torn material such as paper and transparent/opaque vinyl, but the present invention is not limited thereto. Also, the separation film 130 may be formed of a material that is harmless to human body and is capable of melting with heat. A detailed description thereof will be made in the apparatus for producing cosmetics to be described later.

Figure 3:
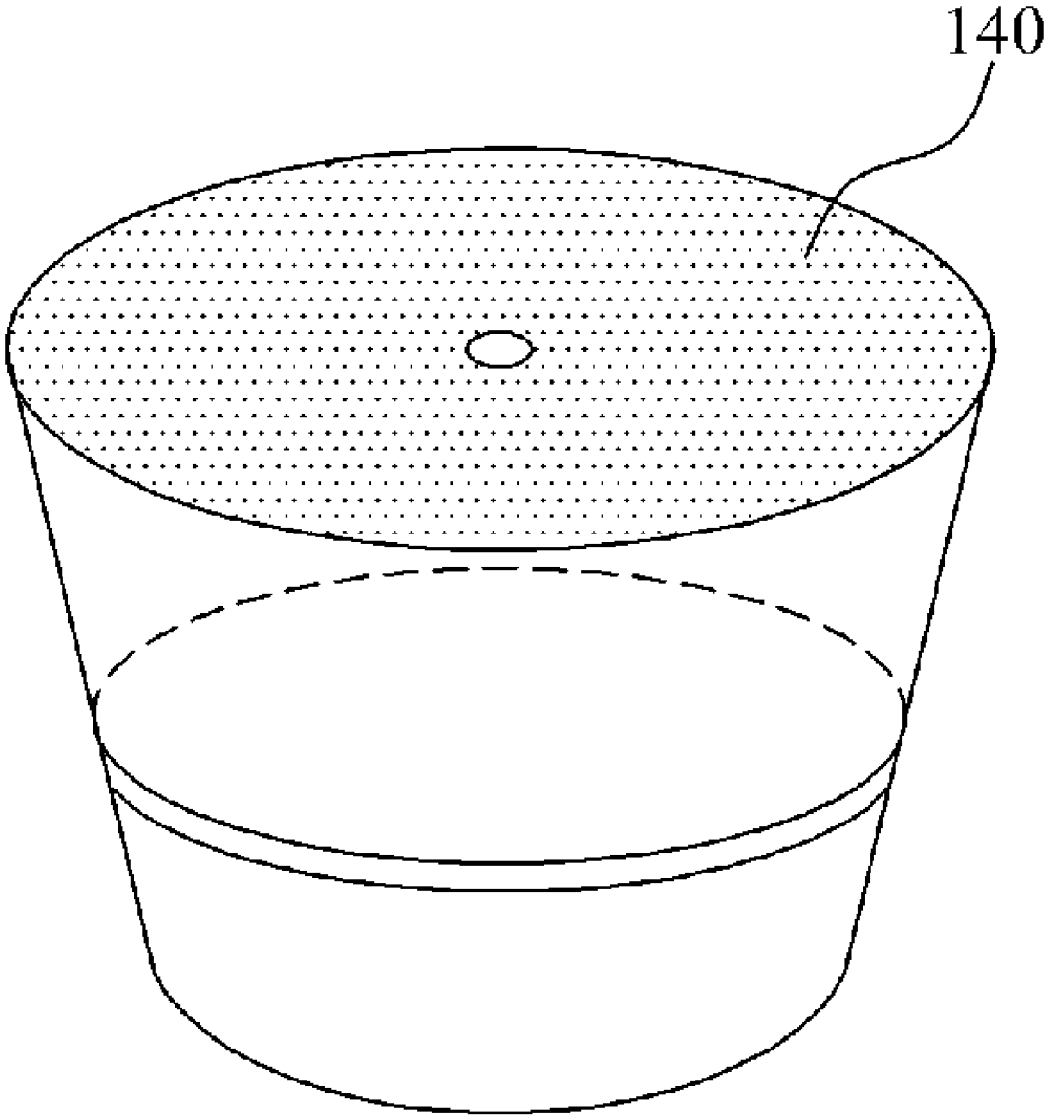
FIG. 3 is an exemplary view illustrating a blocking portion (140) in the cosmetic raw material capsule (100) for separating and accommodating cosmetic raw materials according to an embodiment of the present invention.

FIG. 3 is an exemplary view illustrating a blocking portion 140 in the cosmetic raw material capsule 100 for separating and accommodating cosmetic raw materials according to an embodiment of the present invention. In order to produce cosmetics using the cosmetic raw material capsule 100 in the apparatus for producing cosmetics to be described later, an agitator 213 may be inserted into the cosmetic raw material capsule 100 to agitate at least two cosmetic raw materials contained the cosmetic raw material capsule 100. In this case, cosmetic raw materials may escape through a hole which the agitator 213 is inserted into. Accordingly, the blocking portion 140, as shown in FIG. 3, may be disposed between the accommodating portion 110 and the protective film 120 such that cosmetic raw materials cannot escape from the cosmetic raw material capsule 100 when at least two cosmetic raw materials are agitated by the agitator 213 that is inserted into the cosmetic raw material capsule 100. More specifically, the blocking portion 140 may have a hole formed at the center thereof. Since the agitator 213 is inserted into the cosmetic raw material capsule 100 to agitate cosmetic raw materials, cosmetic raw materials cannot escape out of the cosmetic raw material capsule 100.

Hereinafter, an apparatus 200 for producing cosmetics using the cosmetic raw material capsule 100 for separating and accommodating cosmetic raw materials according to an embodiment of the present invention will be described in detail with reference to FIGS. 4 to 7.

Figure 4:
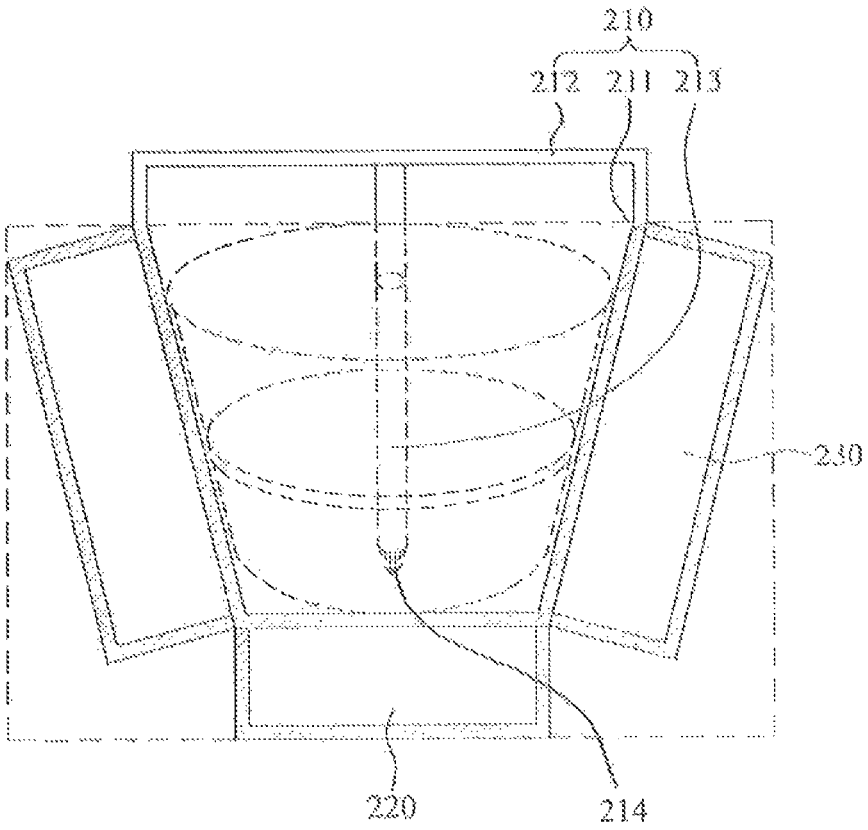
FIG. 4 is a view illustrating a configuration of an apparatus (200) for producing cosmetics using a cosmetic raw material capsule (100) for separating and accommodating cosmetic raw materials according to an embodiment of the present invention.
Figure 5:
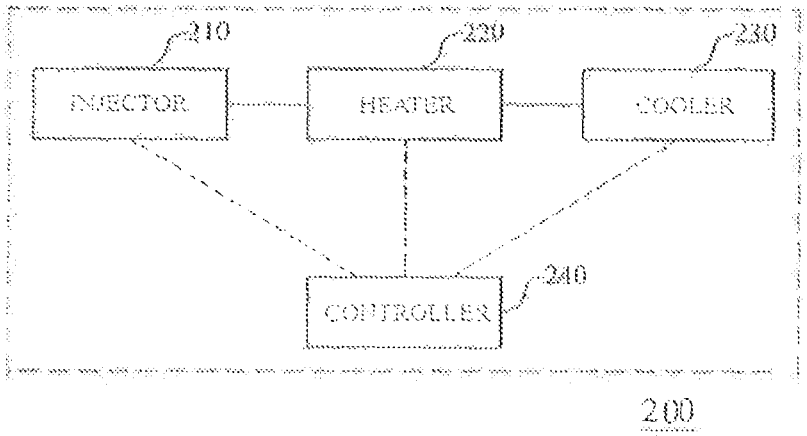
FIG. 5 is a view illustrating an operation of the apparatus (200) for producing cosmetics using a cosmetic raw material capsule for separating and accommodating cosmetic raw materials according to an embodiment of the present invention.

FIG. 4 is a view illustrating a configuration of the apparatus 200 for producing cosmetics using the cosmetic raw material capsule 100 for separating and accommodating cosmetic raw materials according to an embodiment of the present invention. FIG. 5 is a view illustrating an operation of the apparatus 200 for producing cosmetics using the cosmetic raw material capsule 100 for separating and accommodating cosmetic raw materials according to an embodiment of the present invention. As shown in FIGS. 4 and 5, the apparatus 200 for producing cosmetics may include an injector 210, a heater 220, and a cooler 230, and may further include a controller 240.

Figure 6:
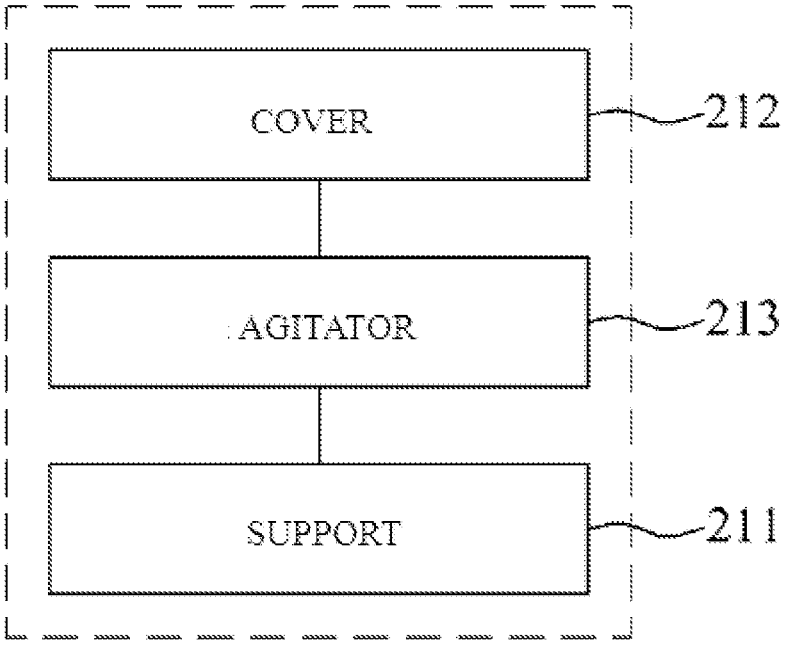
FIG. 6 is a view illustrating a configuration of an injector (210) in the apparatus (200) for producing cosmetics using a cosmetic raw material capsule (100) for separating and accommodating cosmetic raw materials according to an embodiment of the present invention.

The injector 210 may support and fix the cosmetic raw material capsule 100 while at least two cosmetic raw materials contained in the cosmetic raw material capsule 100 are being agitated to produce cosmetics. FIG. 6 is a view illustrating a configuration of the injector 210 in the apparatus 200 for producing cosmetics using the cosmetic raw material capsule 100 for separating and accommodating cosmetic raw materials according to an embodiment of the present invention. Hereinafter, components of the injector 210 will be described in detail with reference to FIG. 6.

First, a support 211 may support the cosmetic raw material capsule 100, and may have a shape similar to the exterior of the cosmetic raw material capsule 100 to support and fix the cosmetic raw material capsule 100. The upper surface of the support 211 may be configured to be tightly coupled to a cover 212. Thus, cosmetic raw material capsule 100 can be strongly fixed while at least two cosmetic raw materials contained in the cosmetic raw material capsule 100 are being agitated.

Next, the cover 212 may be disposed over the support 211 to seal the cosmetic raw material capsule 100 by joining with the support 211. That is, the undersurface of the cover 212 may be configured to be tightly coupled to the support 211. Thus, the cosmetic raw material capsule 100 can be strongly fixed while cosmetics are being produced from the cosmetic raw material capsule 100.

Finally, the agitator 213 may be coupled to the cover 212 to agitate and emulsify at least two cosmetic raw material contained in the cosmetic raw material capsule 100. As shown in FIG. 4, the agitator 213 may be inserted into the cosmetic raw material capsule 100 through the protective film 120 when the cosmetic raw material capsule 100 is located on the support 211 and then the cover 212 is covered thereon to seal the cosmetic raw material capsule 100. More specifically, the agitator 213 may be controlled by an agitator controller 242 connected to a main controller 241 described later, and an impeller may be attached to the lower portion of the agitator 213. The impeller may rotate at a high speed to quickly mix and agitate at least two cosmetic raw materials. Also, the agitator 213 may be configured to further include an ultrasonic wave vibrator 214 that generates an ultrasonic wave to mix and agitate two or more cosmetic raw materials using vibration of the ultrasonic wave.

Meanwhile, in order to mix and agitate cosmetic raw materials using the agitator 213 that is inserted, the separation film 130 needs to be appropriately removed from the accommodating portion 110 of the cosmetic raw material capsule 100. In regard to the material of the separation film 130 described above, when the separation film 130 is formed of an easily torn material such as paper or transparent/opaque vinyl, the agitator 213 may penetrate the separation film 130 to mix and agitate materials contained in the first accommodating portion 111 and the second accommodating portion 112, respectively. When the separation film 130 is formed of a material that is harmless to human body and is capable of melting with heat, the separation film 130 may naturally melt and disappear due to heat applied by the heater 220 described later. Thus, the materials contained in the first accommodating portion 111 and the second accommodating portion 112, respectively, may be mixed and quickly emulsified by the agitator 213. Also, the support 211 may be configured to be rotatable, allowing the cosmetic raw material capsule 100 itself to rotate in the support 211 without the agitator 213. Thus, the materials contained in the first accommodating portion 111 and the second accommodating portion 112, respectively, may be agitated.

The heater 220 may be disposed under the injector 210 to heat at least two cosmetic raw materials contained in the cosmetic raw material capsule 100 supported in the injector 210. For convenience of explanation, the heater 220 is shown as being disposed under the injector 210, but the location of the heater 220 is not limited thereto. In order to produce cosmetics from the cosmetic raw material capsule 100, at least two cosmetic raw materials contained in the cosmetic raw material capsule need to be heated up to a certain temperature while being mixed and agitated so as to be emulsified. For this, the heater 220 may be controlled by a heater controller 243 connected to the main controller 241 described later to heat the cosmetic raw material capsule 100 to a temperature of about 30° C. to about 100° C. The heater 220 may be configured to generate heat using an electric heater, but the present invention is not limited thereto.

The cooler 230 may be disposed at the side surface of the injector 210 to cool cosmetics produced using the cosmetic raw material capsule 100. For convenience of explanation, the cooler 230 is shown as being disposed at the side surface of the injector 210, but the location of the cooler 230 is not limited thereto. Cosmetics produced from the cosmetic raw material capsule 100 may be produced by heating at least two cosmetic raw materials contained in the cosmetic raw material capsule 100 above a certain temperature while being mixed and agitated so as to be emulsified. Accordingly, since the temperature of cosmetics is too high to use immediately, cosmetics needs to be cooled to an appropriate temperature at room temperature for use. The cooler 230 may be controlled by a cooler controller 244 connected to the main controller 241 described later to immediately cool cosmetics produced from the cosmetic raw material capsule 100 to an appropriate temperature to use immediately without damaging the skin. The cooler 230 may be configured to lower the temperature of cosmetics produced from the cosmetic raw material capsule 100 by circulating cooling water, or may be configured to lower the temperature of cosmetics produced from the cosmetic raw material capsule 100 by a compressor cooling method, but the present invention is not limited thereto.

Figure 7:
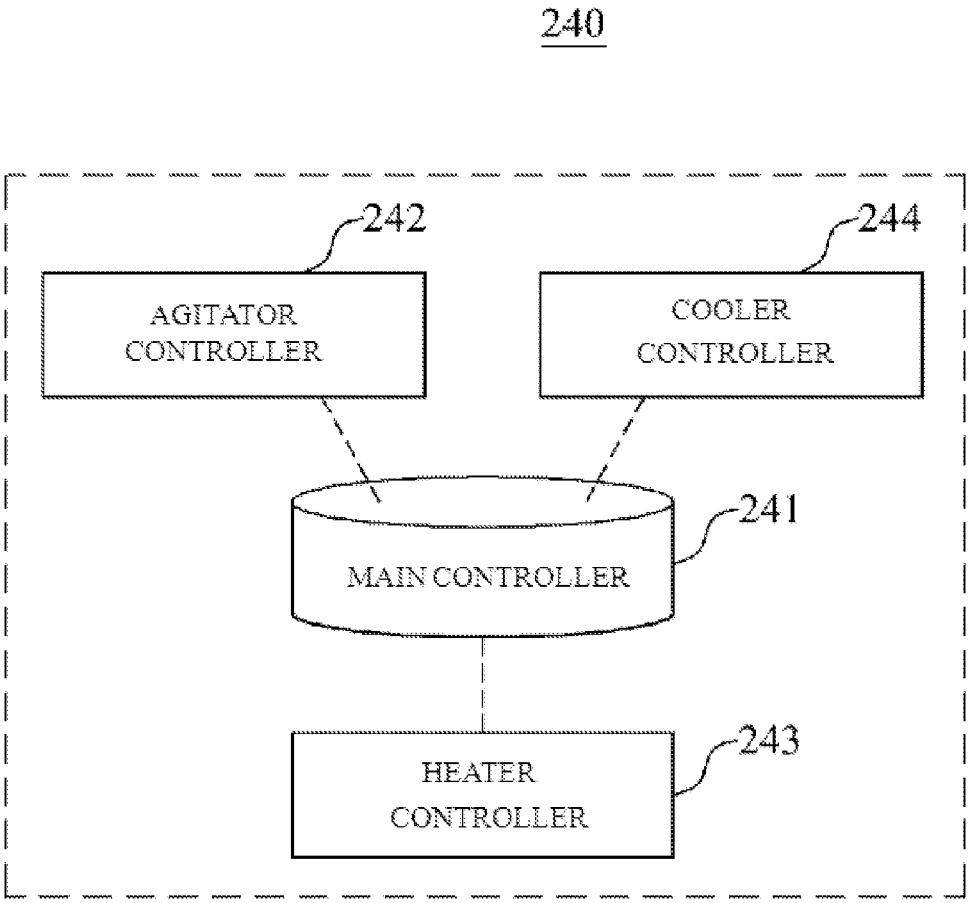
FIG. 7 is a view illustrating a configuration of a controller (240) in the apparatus (200) for producing cosmetics using a cosmetic raw material capsule for separating and accommodating cosmetic raw materials according to an embodiment of the present invention.

The controller 240 may control the operation of the apparatus 200 for producing cosmetics. FIG. 7 is a view illustrating a configuration of the controller 240 in the apparatus for producing cosmetics using the cosmetic raw material capsule 100 for separating and accommodating cosmetic raw materials according to an embodiment of the present invention. As shown in FIG. 7, the controller 240 may include the main controller 241, the agitator controller 242, the heater controller 243, and the cooler controller 244.

The main controller 241 may control the operations of the agitator 213, the heater 220, and the cooler 230 through the agitator controller 242, the heater controller 243, and the cooler controller 244, respectively. That is, the main controller 241 may control the operation of the apparatus 200 for producing cosmetics, thereby conveniently and instantaneously producing cosmetics using the cosmetic raw material capsule 100 suitable for the skin characteristics of a user.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A cosmetic raw material capsule for separating and accommodating cosmetic raw materials, the cosmetic raw material capsule comprising:

a single accommodating portion configured to accommodate at least two cosmetic raw materials;

a protective film disposed over the accommodating portion and configured to cover and seal the accommodating portion; and a separation film disposed in single the accommodating portion as a single sheet and configured to separate the at least two cosmetic raw materials from each other, wherein the separation film is formed of a material capable of melting and dissolving with an application of heat to the cosmetic raw material capsule such that the at least two cosmetic raw materials are mixed with each other.

2. The cosmetic raw material capsule of claim 1, wherein the single accommodating portion comprises:

a first accommodating portion configured to accommodate an oil-based material, a second accommodating portion configured to accommodate a water-based material, and wherein the first accommodating portion and the second accommodating portion are not detachable from one another and form the single accommodating portion.

3. The cosmetic raw material capsule of claim 1, wherein the cosmetic raw material capsule further comprises:

a blocking portion disposed between the single accommodating portion and the protective film and configured to prevent the at least two cosmetic raw materials from escaping from the single accommodating portion.

4. The cosmetic raw material capsule of claim 1, wherein the protective film comprises:

a grip portion disposed at an end of the protective film such that the protective film can be easily removed by a user gripping and pulling the grip portion.

5. An apparatus for producing cosmetics using a cosmetic raw material capsule including a single accommodating portion and a separation film disposed in the single accommodating portion as a single sheet and configured to separate at least two cosmetic raw materials from each other, the separation material being formed of a material capable of melting and dissolving with an application of heat, the apparatus comprising:

an injector configured to be injected into the cosmetic raw material capsule and through the separation film separating the at least two cosmetic raw materials;

a heater disposed under the injector and configured to heat the cosmetic raw material capsule and the separation film so as to melt and dissolve the separation film such that the at least two cosmetic raw materials are mixed with each other; and a cooler disposed at a side of the injector and configured to cool the cosmetic raw material capsule.

6. The apparatus of claim 5, wherein the injector (210) comprises:

a support configured to support the cosmetic raw material capsule;

a cover disposed over the support and configured to cover the cosmetic raw material capsule; and an agitator penetrating the cosmetic raw material capsule in combination with the cover and configured to agitate cosmetic raw materials contained in the cosmetic raw material capsule.

7. The apparatus of claim 6, wherein the agitator comprises an ultrasonic vibrator disposed at a lower end of the agitator and configured to generate an ultrasonic wave.

8. The apparatus of claim 5, further comprising a controller configured to control an operation of the apparatus for producing the cosmetics.

* * * * *